US006530422B2

(12) United States Patent
Zhu et al.

(10) Patent No.: US 6,530,422 B2
(45) Date of Patent: Mar. 11, 2003

(54) HEAT EXCHANGER TUBE, A METHOD FOR MAKING THE SAME, AND A CRACKING FURNACE OR OTHER TUBULAR HEAT FURNACES USING THE HEAT EXCHANGER TUBE

(75) Inventors: Yaoxiao Zhu; Zhi Zheng, both of Shenyang; Qingquan Zeng, Beijing; Ning Xiuzhen; Lou Langhong, both of Shenyang; Shiqun Xu; Guoqing Wang, both of Beijing; Qingju Bai, Shenyang, all of (CN)

(73) Assignees: China Petro-Chemical Corporation, Beijing (CN); Institute of Metal Research Science Academy of China, Shenyang (CN); China Petro-Chemical Corporation Beijing Research Intitute of Chemical Industry, Beijing (CN)

( * ) Notice: Subject to any disclaimer, the term of this patent is extended or adjusted under 35 U.S.C. 154(b) by 0 days.

(21) Appl. No.: 09/963,014

(22) Filed: Sep. 25, 2001

(65) Prior Publication Data

US 2002/0007941 A1 Jan. 24, 2002

Related U.S. Application Data

(62) Division of application No. 09/396,639, filed on Sep. 16, 1999.

(30) Foreign Application Priority Data

Sep. 16, 1998 (CN) ..... 98114311 A

(51) Int. Cl.[7] ..... F28F 13/12
(52) U.S. Cl. ..... 165/109.1; 165/177; 138/38
(58) Field of Search ..... 165/174, 177, 165/109.1; 138/38

(56) References Cited

U.S. PATENT DOCUMENTS

| | | | | |
|---|---|---|---|---|
| 166,780 A | * | 8/1875 | Bailey | 165/38 |
| 1,459,024 A | * | 6/1923 | Hartburg | 138/38 |
| 2,070,427 A | | 2/1937 | Faunce | 165/184 |
| 2,864,405 A | * | 12/1958 | Ypung | 165/109.1 |
| 2,929,408 A | | 3/1960 | Weatherwax et al. | 29/890.049 |
| 2,960,114 A | | 11/1960 | Hinde | 165/183 |

(List continued on next page.)

FOREIGN PATENT DOCUMENTS

| | | | | |
|---|---|---|---|---|
| CN | 87203192 | | 3/1988 | |
| EP | 257220 | * | 2/1988 | 165/177 |

OTHER PUBLICATIONS

U.S. patent application Ser. No. 09/396639 for "Heat Exchanger Tube, a Method for Making the Same, and a Cracking Furnace or Other Tubular Heat Furnaces Using the Heat Exchanger Tube" by Zhu et al. filed Sep. 16, 1999.

*Primary Examiner*—Henry Bennett
*Assistant Examiner*—Terrell McKinnon
(74) *Attorney, Agent, or Firm*—Baker Botts L.L.P.

(57) ABSTRACT

A heat exchanger tube, having at least one twisted baffle therein, each of said twisted baffles extends in the inside of the heat exchanger tube along the axis thereof, said twisted baffles extends as long as at least a part of the entire length of said heat exchanger tube, and said twisted baffles are integrated with the inner surface of said heat exchanger tube. The twisted angle of said twisted baffles is between 100° to 360°. The ratio between the axial length of said heat exchanger tube with the twisted angle 180° of said twisted baffles and the internal diameter of said heat exchanger tube is 2 to 3. The thickness of said twisted baffles is approximated to that of said heat exchanger tube; in every cross section of said heat exchanger tube, the transition zone from the surface of said twisted baffles to the surface of said heat exchanger tube, and vice versa, is in the shape of a concave circular arc. The present invention also relates to a cracking furnace tube, which uses at least one said heat exchanger tube according to the present invention, any two of said heat exchanger tubes are separated from each other in at least one section of the radiation heating furnace tube, the distance between the two adjacent said heat exchanger tubes is at least 5 pitches.

5 Claims, 3 Drawing Sheets

(1 of 3 Drawing Sheet(s) Filed in Color)

U.S. PATENT DOCUMENTS

| | | | | | |
|---|---|---|---|---|---|
| 3,086,372 | A | | 4/1963 | Barger et al. | 165/109.1 |
| 3,110,754 | A | | 11/1963 | Witort et al. | 29/890.049 |
| 3,394,736 | A | | 7/1968 | Pearson | 165/109.1 |
| 3,407,871 | A | * | 10/1968 | Penney | 165/109.1 |
| 3,629,929 | A | | 12/1971 | Wessel | 29/403 |
| 3,636,982 | A | | 1/1972 | Drake | 165/109.1 |
| 3,710,773 | A | | 1/1973 | Piech et al. | 123/188 |
| 4,045,857 | A | | 9/1977 | Suzuki | 29/420 |
| 4,090,559 | A | | 5/1978 | Megerlin | 165/179 |
| 4,559,998 | A | * | 12/1985 | Counterman | 165/109.1 |
| 5,174,653 | A | * | 12/1992 | Halat et al. | 138/38 |
| 5,307,867 | A | * | 5/1994 | Ysuda et al. | 165/109.1 |
| 5,409,057 | A | | 4/1995 | Zifferer | 165/177 |

* cited by examiner

HEAT EXCHANGER TUBE, A METHOD FOR MAKING THE SAME, AND A CRACKING FURNACE OR OTHER TUBULAR HEAT FURNACES USING THE HEAT EXCHANGER TUBE

This is a divisional of application Ser. No. 09/396,639 filed Sep. 16, 1999, claiming priority to China Application 98114311.3 filed Sep. 16, 1998.

FIELD OF THE INVENTION

The present invention relates to a heat exchanger tube which is used in ethylene cracking furnace or other tubular heat furnaces to increase the efficiency of the heat transfer. Especially, the present invention relates to an ethylene cracking furnace or other tubular heat furnaces. The present invention further relates to a method for making the heat exchanger tube according to the present invention, i.e., making the heat exchanger tube with a twisted baffle integrated with its inner surface by means of smelting the raw material in the vacuum condition and precision casting with the model being burning away.

BACKGROUND OF THE INVENTION

As those skilled in the art know, the key to increase the output of some chemical products such as ethylene and propylene is to increase the temperature for cracking and shorten the time of the raw materials staying in the furnace tubes. For this purpose, the efficiency of the heat transfer of the furnace tubes must be tried to be increased.

In this way, some manufactures in the world have used a kind of furnace tube, the inner surface of which are integrally provided with a plurality of spiral ribs, the cross section of this kind of furnace tube is shaped as a plum blossom. The central portion of this kind of furnace tube is hollow. In this construction, the area of the inner surface of this kind of furnace tube is increased, so the area used for heat transfer is increased. For this reason, the efficiency of the heat transfer of the furnace tubes is also increased. However, inside this kind of furnace tube, the flowing speed in the central portion is much faster than that on the inner wall, resulting in a marked difference in temperature between the central portion and the inner wall. This in turn will make it more possible to result in not fully cracking and begin coking.

In recent years, those skilled in the art have been trying to find a technical solution which can increase the area used for heat transfer so as to increase the efficiency of the heat transfer of the furnace tubes while minimizing the differences between the flowing speed in the central portion of this kind of furnace tube and that on the inner wall thereof, and minimizing the difference in temperature between the central portion and the inner wall, so as to make more fully cracking inside the furnace tubes. Chinese Utility Model CN 87 2 03192U discloses a baffle construction for increasing the efficiency of the heat transfer, comprising a heat exchanger tube and a twisted baffle. Said twisted baffle is fabricated from an elongated generally rectangular sheet of flat metal. On each of the pair of straight parallel side edges in length of the raw sheet of metal are provided with a plurality of rectangular teeth. The flat sheet of metal with rectangular teeth on its side edges in length is twisted to form said twisted baffle. Such twisted baffle is inserted into said heat exchanger tube. It is clear that only the two ends of the twisted baffle can be welded on said heat exchanger tube. The Chinese Utility Model can make more fully cracking inside the furnace tubes. Unfortunately, the middle portion of the twisted baffle can not be welded on the inner wall of said heat exchanger tube. As the flowing speed of the raw material is fast enough to impact heavily on the twisted baffle inside the heat exchanger tube, making such shaped baffle being subject to a strong vibrating excitation, so as to be damaged easily. Moreover, between the outer profile of the twisted baffle and the inner wall of the heat exchanger tube, and between every two adjacent rectangular teeth on the side edges in length of said twisted baffle, are always generating small eddy. This make it more possible to result in not fully cracking and begin coking.

OBJECT OF THE INVENTION

The object of the present invention is to provide a heat exchanger tube which is used to further increase the efficiency of the heat transfer, make it less possible to begin coking, always work well and be reliability during heat exchanging, and be able to work for a longer time.

Another object of the present invention is to provide a heat exchanger tube, the surface of the twisted baffle of the heat exchanger tube is smooth enough, the inner wall of the heat exchanger tube is finished enough, and the errors in dimension and in geometrical form are small enough.

The further object of the present invention is to provide a method for making the heat exchanger tube according to the present invention, to make the heat exchanger tube with a twisted baffle integrated with its inner surface in a simple, easy and low cost way.

Another object of the present invention is to provide a cracking furnace which uses the heat exchanger tube according to the present invention, not only being able to make the in-process materials go forward while being in a helical motion itself so as to increase the efficiency of the heat transfer, but also not notably making the flowing speed of the in-processing flow slower; not only increasing the output of the desired chemical product, but also lengthening the period to clear the coking.

The further object of the present invention is to provide a tubular heat furnace which uses the heat exchanger tube according to the present invention, being able to increase the efficiency of the heat transfer with low cost and process more in-process materials.

TECHNICAL SOLUTIONS OF THE INVENTION

According to the first aspect of the present invention, there is provided a heat exchanger tube, which has at least one twisted baffle therein, each of said twisted baffles extends in the heat exchanger tube along the axis thereof, said twisted baffles extends as long as at least a part of the entire length of said heat exchanger tube, and said twisted baffles are integrated with the inner surface of said heat exchanger tube.

Preferably, the twisted angle of said twisted baffles is between 100° to 360°.

Preferably, the ratio between the axial length of said heat exchanger tube with the twisted angle 180° of said twisted baffles and the internal diameter of said heat exchanger tube is 2 to 3.

Preferably, the thickness of said twisted baffles is approximated to that of said heat exchanger tube; in every cross section of said heat exchanger tube, the transition zone from the surface of said twisted baffles to the surface of said heat exchanger tube, and vice versa, is in the shape of a concave circular arc.

Preferably, said the heat exchanger tube with a twisted baffle integrated with its inner surface is made by means of smelting the raw material in the vacuum condition and precision casting with the model being burning away.

According to the second aspect of the present invention, there is provided a cracking furnace tube, which uses at least one said heat exchanger tube according to the present invention, any two of said heat exchanger tubes are separated from each other in at least one section of the radiation heating furnace tube, the distance between the two adjacent said heat exchanger tubes is at least 5 pitches.

Preferably, the distance between the two adjacent said heat exchanger tubes is 15 to 20 pitches.

According to the third aspect of the present invention, there is provided a tubular heat furnace, which uses at least one said heat exchanger tube according to the present invention, any two of said heat exchanger tubes are separated from each other in at least one section of the radiation heating furnace tube, the distance between the two adjacent said heat exchanger tubes is at least 5 pitches.

Preferably, the distance between the two adjacent said heat exchanger tubes is 15 to 20 pitches.

According to the forth aspect of the present invention, there is provided a method for making the heat exchanger tube according to the present invention, which includes the steps of smelting the raw material in the vacuum condition and precision casting with the model being burning away, wherein the model used for forming the twisted baffle is composed of a plurality of parts, a profile in conformity with the surface shape of said twisted baffle is formed when combining every parts of said model together.

Advantages of the Invention

According to the technical solutions, when the in-process materials pass through the surface of said twisted baffle inside said heat exchanger tube, said twisted baffle directs the in-process materials away from the center of said heat exchanger tube, flowing forward helically other than straight ahead, so that the in-process materials passing through inside said heat exchanger tube flows laterally while going ahead, so as to strongly spray onto the inner surface of said heat exchanger tube. In this way, the thickness of the boundary statically flowing layer on the inner surface of said heat exchanger tube becomes much thinner, so that the heat resistance of the boundary layer on the inner surface of said heat exchanger tube is much smaller, therefore, the efficiency of the heat transfer of said heat exchanger tube can be increased.

As the efficiency of the heat transfer of said heat exchanger tube is increased, the temperature on the inner surface of said heat exchanger tube is lowered accordingly. This in turn make it more possible to prevent coking, so as to further increase the efficiency of the heat transfer of said heat exchanger tube.

According to the present invention, each helical passage defined by the inner wall of the heat exchanger tube and the surface of the twisted baffle is smooth and finished enough, forming no dead space for resisting the flow of the in-process materials. With this reasons, it is more possible to prevent coking and further increase the efficiency of the heat transfer of said heat exchanger tube.

According to the present invention, said twisted baffles are integrated with the inner surface of said heat exchanger tube, so that said twisted baffles are not easy to be damaged. Therefore, said heat exchanger tube can always work well and be reliability during heat exchanging, and be able to work for a longer time.

According to the method for making the heat exchanger tube according to the present invention, the heat exchanger tube is made by so called precision casting, therefore, it can make sure that the surface of the twisted baffle of the heat exchanger tube is smooth enough, the inner wall of the heat exchanger tube is finished enough, and the errors in dimension and in geometrical form are small enough.

As the surface of the twisted baffle of the heat exchanger tube is smooth enough, the resistance to the flow of the in-process materials can be minimized, therefore, no eddy can be formed in any point of the in-process materials passage. With this reasons, it is more possible to prevent coking.

According to the method for making the heat exchanger tube according to the present invention, the heat exchanger tube is made by so called casting, therefore, it can make sure that the heat exchanger tube can be made in a simple, easy and low cost way. Moreover, as the heat exchanger tube is made by casting, the heat exchanger tube is weldable so as to be able to be welded into the furnace tube, in this way, the heat exchanger tube can be connected to the furnace tubes in a simple, easy and low-cost way.

According to the present invention, in the cracking furnace tube, any heat exchanger tube with the twisted baffle(s) is axially provided between two furnace tubes located outside the two ends thereof respectively, and any two of said heat exchanger tubes are separated from each other in the furnace tube, that is to say, said heat exchanger tube with the twisted baffle(s) is only provided in one or more portions of the furnace tubes, so that the total length of all said heat exchanger tubes with the twisted baffle(s) is only a small part of the entire length of the furnace tubes. Therefore, the resistance to the flowing in-process materials can not be increased greatly, so that the in-process materials can not only go forward while being in a helical motion itself so as to increase the efficiency of the heat transfer, but also not notably make the flowing speed of the in-processing flow slower.

With the help of said twisted baffle inside said heat exchanger tube, said twisted baffle directs the in-process materials laterally away from the center of said heat exchanger tube while flowing forward, so that the in-process materials strongly spray onto the inner surface of said heat exchanger tube, making the thickness of the boundary statically flowing layer on the inner surface of said heat exchanger tube much thinner, so that the heat resistance of the boundary layer on the inner surface of said heat exchanger tube is much smaller, therefore, the flowing speed of the in-process materials can suitably be faster.

In the present invention, as said heat exchanger tube has said twisted baffle therein, resulting in a tendency to increase the resistance to the flowing in-process materials, however, the negative influence resulted from this tendency is much smaller than the positive influence come from the efficiency of the heat transfer being increased. On the other hand, the temperature of the flowing in-process materials flowing near the inner surface of said heat exchanger tube is lowered. This in turn make it more possible to prevent coking on the inner surface of said heat exchanger tube, therefore, with the help of said heat exchanger tube according to the present invention, not only the output of the desired chemical product can be increased, but also the period for clearing the coking can be lengthen.

By means of adding said heat exchanger tube with the twisted baffle(s) into the furnace tubes, the temperature on the inner surface of said the radiation heating furnace tube of the cracking furnace tube is lowered, said the radiation heating furnace tube of the cracking furnace tube can be used for a longer time.

With the same reasons, by means of adding said heat exchanger tube with the twisted baffle(s) into the tubular heat furnace, the efficiency of the heat transfer of the tubular heat furnace can be increased, and more flowing in-process materials can be gone through.

BRIEF DESCRIPTION OF THE ACCOMPANY DRAWINGS

The file of this patent contains two drawings executed in color. Copies of this patent with color photographs will be provided by the Patent and Trademark Office upon request and payment of the necessary fee.

Above and further objects and advantages will be more easily understood from the following detailed description of the preferred embodiments taken together with the accompany drawings, wherein FIG. 1 is a perspective photograph of some heat exchanger tubes with the twisted baffle according to the present invention;

DETAILED DESCRIPTION OF THE INVENTION

Figure 1:
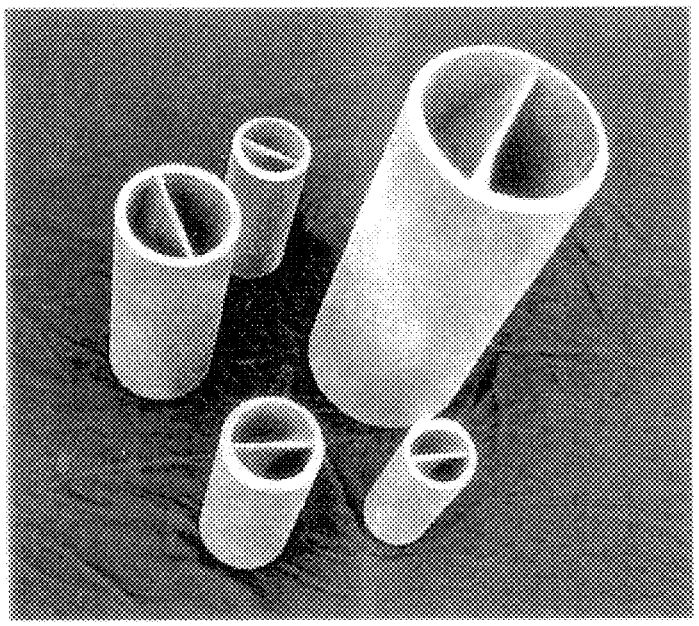
Figure 2:
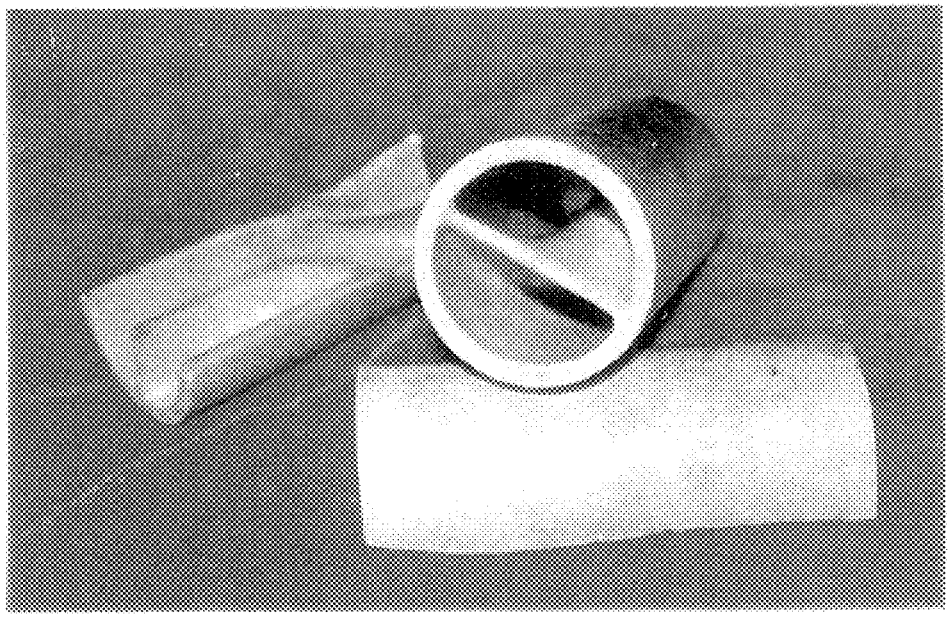
FIG. 2 is a perspective cutaway photograph of a heat exchanger tube with the twisted baffle according to the present invention.

Reference is at first made to FIGS. 1 and 2 which are perspective photographs of some heat exchanger tubes with the twisted baffle according to the present invention. The perceptual knowledge of the heat exchanger tubes with the twisted baffle according to the present invention can be obtained from the FIGS. 1 and 2.

FIGS. 3 to 7 illustrate a preferred embodiment of the heat exchanger tube with a twisted baffle according to the present invention in more detail.

Figure 4:
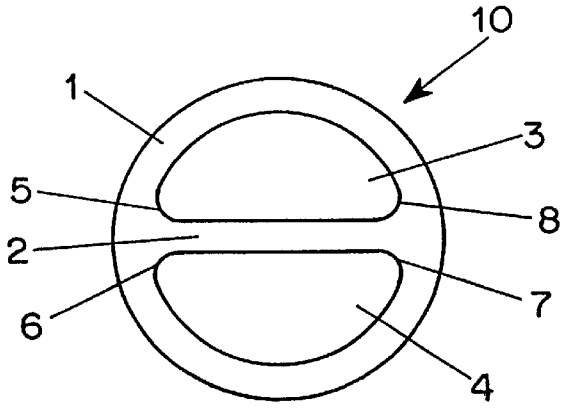
FIG. 4 is an end view of a preferred embodiment of the heat exchanger tubes as shown in FIG. 3 in the direction of the arrows A or E.

According to the present embodiment, as seen from the section shown in the FIG. 4, a heat exchanger tube 10 with a twisted baffle according to the present invention comprises a tube or flue portion 1, and a twisted baffle or turbulator portion 2. Said twisted baffle portion 2 is integrated with said tube portion 1 of the heat exchanger tube 10. As shown in the FIG. 4, said twisted baffle portion 2 extends diametrically across said tube portion 1 so as to divide the inner cavity of the heat exchanger tube 10 into a pair of passages 3 and 4 for flowing in-process materials. Said passages 3 and 4 have a substantially equal cross sectional area.

According to the concept of this invention, in every cross section of said heat exchanger tube, each of the transition zones between the surface of said twisted baffles and the surface of said heat exchanger tube in the passages 3 and 4, i.e., the corner portions 5, 6, 7 and 8 as shown in the FIG. 4, are in the shape of a concave circular arc. Especially, the radius of said concave circular arc can not be too long, otherwise, the passages 3 and 4 will be too narrow so as to limit the flow rate of the in-process materials. On the other hand, the radius of said concave circular arc can not be too short, otherwise, the in-process materials will form eddy and be easy to begin coking in above-mentioned corner portions.

Figure 3:
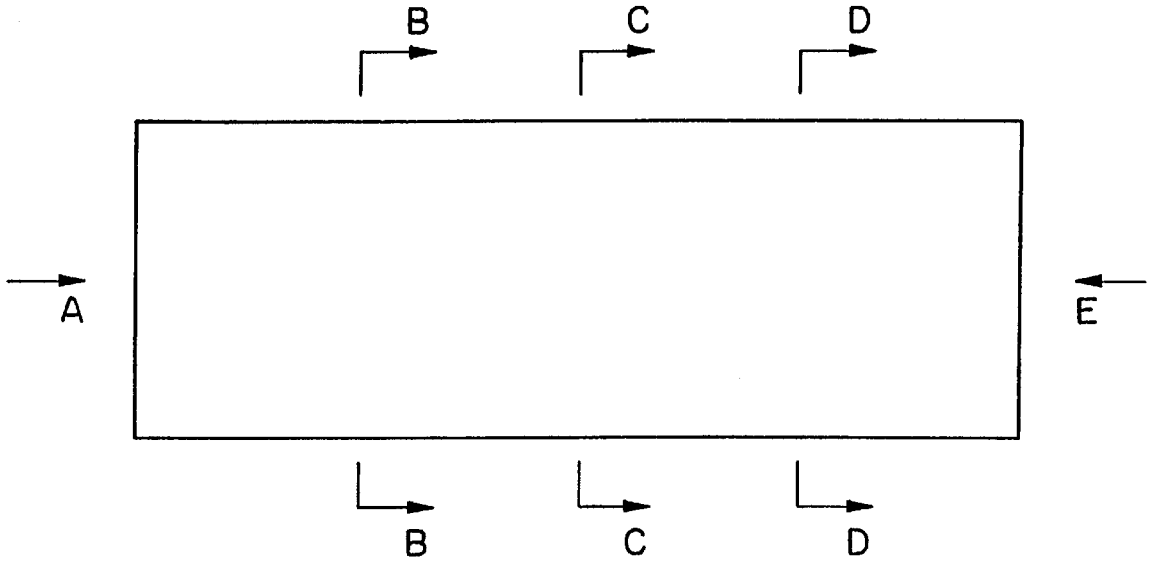
FIG. 3 is a side view of a preferred embodiment of the heat exchanger tube with a twisted baffle according to the present invention, marking the positions of section B—B, C—C, and D—D.

FIG. 3 shows a preferred embodiment of the heat exchanger tube with a twisted baffle according to the present invention. In this embodiment, the length of the heat exchanger tube is as long as a pitch (the term will be defined in the following context), so that the end cross section seen in the direction of the arrow A is same as that seen in the direction of the arrow E. As shown in the FIG. 4, the twisted baffle portion 2 is shown in the horizontal state.

Figure 5:
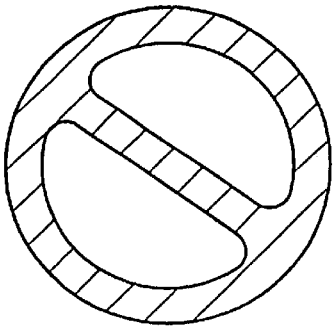
FIG. 5 shows a section B—B of a preferred embodiment of the heat exchanger tubes as shown in FIG. 3.

FIG. 5 shows a section of the heat exchanger tubes as shown in FIG. 3, which is located in the point of ¼ of the entire length of the heat exchanger tubes counted from the left end thereof As shown in the FIG. 5, the twisted baffle portion 2 is shown in the inclined state with an angle 45° of inclination leftward and upward.

Figure 6:
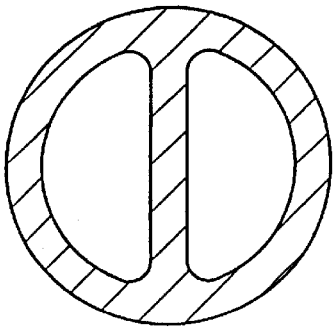
FIG. 6 shows a section C—C of a preferred embodiment of the heat exchanger tubes as shown in FIG. 3.

FIG. 6 shows a section of the heat exchanger tubes as shown in FIG. 3, which is located in the point of ½ of the entire length of the heat exchanger tubes counted from the left end thereof. As shown in the FIG. 6, the twisted baffle portion 2 is shown in the vertical state.

Figure 7:
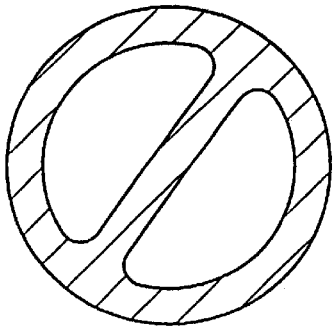
FIG. 7 shows a section D—D of a preferred embodiment of the heat exchanger tubes as shown in FIG. 3.

FIG. 7 shows a section of the heat exchanger tubes as shown in FIG. 3, which is located in the point of ¾ of the entire length of the heat exchanger tubes counted from the left end thereof. As shown in the FIG. 6, the twisted baffle portion 2 is shown in the inclined state with an angle 45° of inclination rightward and upward.

In a word, in the present embodiment of the heat exchanger tube with a twisted baffle according to the present invention, the geometrical form and dimensions in every axially cross sections of the heat exchanger tube 10 are always the same as one another, with only one difference that the twisted baffle portion 2 is in different angle of inclination. The shape of the twisted baffle portion 2 can be figured out with the FIGS. 3 to 7.

In fact, the twisted baffle portion 2 can be twisted both in the left-handed way and in the right handed way.

Especially, in another embodiment, the twisted baffle portion is not designed to extend diametrically across the tube portion, but is designed to offset a diameter, so that the inner cavity of the heat exchanger tube is divided into two passages for flowing in-process materials. In this case, the two passages have different cross sectional area.

More particularly, the surface of the twisted baffle portion in any axially cross sections of the heat exchanger tube 10 not only can be designed to be linear, but also can be designed to be curvilinear.

If needed in practice, the twisted baffle portion can be designed to a more complex form so as to divide the inner cavity of the heat exchanger tube into more than two passages for the flowing in-process materials.

In fact, in the heat exchanger tube according to the present invention, said twisted baffles can extend as long as the entire length of said heat exchanger tube, however, said twisted baffles can also extend as long as a part of the entire length of said heat exchanger tube.

In the present invention, the so called term "pitch" S is defined by axial length of the heat exchanger tube with the twisted angle 180° of the twisted baffle. So called term "twisted ratio" Y is defined by the ratio between the pitch S and the internal diameter D of said heat exchanger tube, that is, Y=S/D.

Accordingly, the smaller is the value of Y, the more twisted degree has the twisted baffle, the easier does the in-process materials passing through inside said heat exchanger tube flow laterally while going ahead, the higher is the efficiency of the heat transfer, and the more possible is it to prevent coking. However, if the value of Y is too small, the resistance to the flowing in-process materials will be increased greatly, so that the flowing speed of the in-process materials will be limited.

On the other hand, the bigger is the value of Y, the more difficult does the in-process materials passing through inside said heat exchanger tube flow laterally while going ahead, the smaller is the resistance to the flowing in-process materials, the lower is the efficiency of the heat transfer, and the less possible is it to prevent coking.

Therefore, it is very important to determine a suitable twisted ratio. In the present invention, although Y=2.5 is the best value of the twisted ratio, Y=2 to 3 is also a excellent value thereof.

In another embodiment, the tube portion of the heat exchanger tube can also be generally in the shape of ellipse.

If the heat exchanger tube with the twisted baffle(s) according to the present invention is axially provided in the entire length of the furnace tubes of the cracking furnace tube, then the efficiency of the heat transfer can be greatly increased. However, the resistance to the flowing in-process materials will also be increased greatly, so that the flowing speed of the in-processing flow is made lower. For this reason, in the present invention, said heat exchanger tube with the twisted baffle(s) is only arranged in one or more places of the furnace tubes, and any two of said heat exchanger tubes are separated from each other in the furnace tube. That is to say, any heat exchanger tube with the twisted baffle(s) according to the present invention is axially provided between two conventional furnace tubes without any baffle therein. As the in-process materials has a helical inertia force, the in-process materials can still go ahead while are helically rotating in the conventional furnace tubes without any baffle therein. According to a preferred embodiment of the present invention, any two of said heat exchanger tubes are separated from each other in the radiation heating furnace tube, and the interval between any two adjacent said heat exchanger tubes is at least 5 pitches.

Preferably, the interval between any two adjacent said heat exchanger tubes is 15 to 20 pitches.

In another embodiment, some of the furnace tubes are arranged with said heat exchanger tube according to the present invention, the other furnace tubes are not arranged with said heat exchanger tube. In another word, said heat exchanger tube according to the present invention can only arranged in a part of the furnace tubes.

In the embodiments of the present invention, said heat exchanger tube according to the present invention can be mounted in the furnace tubes which are arranged in a horizontal orientation, in a vertical orientation or in any incline orientation.

Figure 8:
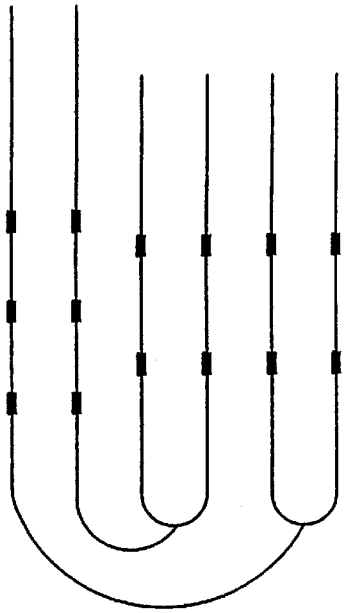
FIG. 8 schematically shows a preferred embodiment of a layout of the heat exchanger tubes according to the present invention, which is provided axially in the radiation heating furnace tube of an ethylene cracking furnace or in the furnace tube of other tubular heat furnaces.

FIG. 8 schematically shows a preferred embodiment of a layout of the heat exchanger tubes according to the present invention, which is provided axially in the radiation heating furnace tube of an ethylene cracking furnace. In the entire length of the radiation heating furnace tube of the cracking furnace, the value of the twisted ration Y of all twisted baffles can be the same as one another. However, the value of the twisted ration Y of one twisted baffle can be different from that of another. The value of the twisted ration Y of each twisted baffle can be designed as practical need. The distance between the two adjacent said heat exchanger tubes can be same as the distance between the another two adjacent said heat exchanger tubes. However, the distance between the two adjacent said heat exchanger tubes can also be different from the distance between the another two adjacent said heat exchanger tubes. The distance between any two adjacent said heat exchanger tubes can be designed as practical need.

In another embodiment, the axial length of said heat exchanger tube according to the present invention can be less than a pitch. In another embodiment, the axial length of said heat exchanger tube according to the present invention can also be greater than a pitch. In another word, the twisted angle of said twisted baffle(s) can be less than 180°, but can also be equal or greater than 180°. In the present invention, the twisted angle of said twisted baffle(s) is between 100° to 360°. Preferably, the twisted angle of said twisted baffle(s) is between 100° to 200°.

Alternatively, if the twisted baffles is too thick, the passages 3 and 4 will be too narrow so as to limit the flow rate of the in-process materials. On the other hand, if the twisted baffles is too thin, as the twisted baffles is subject to the impact from the in-process materials, said heat exchanger tube will be used for a shorter term. In the present invention, the thickness of said twisted baffles approximates to 80% of that of said heat exchanger tube. In fact, when the thickness of said twisted baffles approximates to that of said heat exchanger tube, the advantages of the present invention can always be realized.

Preferably, said heat exchanger tubes can be axially welded in the radiation heating furnace tube. Besides, said heat exchanger tubes are axially connected with the radiation heating furnace tubes by screw thread or other suitable means.

While the heat exchanger tube according to the present invention can be used in ethylene or other chemical product cracking furnace so as to increase the efficiency of the heat transfer, it is contemplated that the heat exchanger tube according to the present invention can be used in any other tubular heat furnaces. Therefore, said heat exchanger tubes according to the present invention can be used in the furnace tube of any other tubular heat furnaces.

Especially, a method for making the heat exchanger tube according to the present invention includes such steps of smelting the raw material in the vacuum condition, and precision casting with the model being burning away, wherein, the model used for forming the twisted baffle is composed of a plurality of parts, and a profile in conformity with the surface shape of said twisted baffle is formed when combining every parts of said model together.

While the invention has been explained by detailed descriptions of the preferred embodiments, it is understood that various modifications and substitutions can be made in any of them within the scope of the appended claims which are intended also to include equivalents of such embodiments.

We claim:

1. A cracking furnace tube, comprising at least one heat exchanger tube, said heat exchanger tube having at least one section of a length L axially of the tube and of an internal diameter D having a twisted baffle therein, the baffle having a twist angle of between 100° to 360° along the section, the baffle being integral with the section and having entirely along the section a concavely curved transition zone at a juncture between each face of the baffle and the inner surface of the tube so as to prevent the formation of eddies, wherein the twist ratio Y between the pitch S of the baffle and the internal diameter D is between 2 and 3, the pitch being the axial length of that part of the baffle that has a twist angle of 180°;

wherein any two of said heat exchanger tubes are separated from each other in at least one section of the radiation heating furnace tube, and wherein the distance between said any two of said heat exchanger tubes is at least 5 pitches.

2. A cracking furnace tube according to claim 1, wherein the distance between said any two of said heat exchanger tubes is 15 to 20 pitches.

3. A tubular heat furnace, comprising:

at least one heat exchanger tube having at least one section of a length L axially of the tube and of an internal diameter D having a twisted baffle therein, the baffle having a twist angle of between 100° to 360° along the section, the baffle being integral with the section and having entirely along the section a concavely curved transition zone at a juncture between each face of the baffle and the inner surface of the tube so as to prevent the formation of eddies, wherein the twist ratio Y between the pitch S of the baffle and the internal diameter D is between 2 and 3, the pitch being the axial length of that part of the baffle that has a twist angle of 180°;

wherein any two of said heat exchanger tubes are separated from each other in at least one section of the radiation heating furnace tube, and the distance between said any two of said heat exchanger tubes is at least 20 pitches.

4. A tubular heat furnace according to claim 3, wherein the distance between said any two of said heat exchanger tubes is 15 to 20 pitches.

5. A method for making a heat exchanger tube according to the present invention, comprising:

smelting raw material in a vacuum condition, and precision casting with a model being burned away, wherein said model is comprised of a plurality of parts, said plurality of parts being chosen for forming the heat exchanger tube, the heat exchanger tube having at least one section of a length L axially of the tube and of an internal diameter D having a twisted baffle therein, the baffle having a twist angle of between 100° to 360° along the section, the baffle being integral with the section and having entirely along the section a concavely curved transition zone at a juncture between each face of the baffle and the inner surface of the tube so as to prevent the formation of eddies, wherein the twist ratio Y between the pitch S of the baffle and the internal diameter D is between 2 and 3, the pitch being the axial length of that part of the baffle that has a twist angle of 180°.

* * * * *

UNITED STATES PATENT AND TRADEMARK OFFICE

CERTIFICATE OF CORRECTION

PATENT NO. : 6,530,422 B2
DATED : March 11, 2003
INVENTOR(S) : Zhu et al.

It is certified that error appears in the above-identified patent and that said Letters Patent is hereby corrected as shown below:

Title page,
Item [56], References Cited, U.S. PATENT DOCUMENTS, "166,780 A 8/1875 Bailey" should read -- 166,180 A 8/1875 Bailey --
Item [57], ABSTRACT,
Line 4, "extends' should read -- extend --
Item [73], Assignee, "Intitute" should read -- Institute --

Column 1,
Line 32, "are" should read -- is --

Column 2,
Line 11, "eddy" should read -- eddies --; and "make" should read -- makes --
Line 51, "extends" should read -- extend --

Column 3,
Line 41, "flows" should read -- flow --

Column 4,
Line 1, "reliability" should read -- reliable --
Line 13, "With this reasons," should read -- For this reason, --
Line 60, "make" should read -- makes --
Line 65, "lengthen." should read -- lengthened. --

Column 5,
Line 5, "With" should read -- For --
Line 9, "be gone" should read -- go --
Line 11, "ACCOMPANY" should read -- ACCOMPANYING --
Line 20, "pany" should read -- panying --

Column 6,
Line 3, "cross sectional" should read -- cross-sectional --
Line 14, "eddy" should read -- eddies --
Line 41, "In a word," should read -- In other words, --
Line 58, "axially" should read -- axial --

Column 7,
Lines 10 and 19, "does" should be deleted
Line 39, "of' should read -- in --
Line 44, "has" should read -- have --
Line 46, "are" should be deleted
Line 57, "In another word," should read -- In other words, --
Line 59, "arranged" should read -- be arranged --

UNITED STATES PATENT AND TRADEMARK OFFICE

CERTIFICATE OF CORRECTION

PATENT NO. : 6,530,422 B2
DATED : March 11, 2003
INVENTOR(S) : Zhu et al.

It is certified that error appears in the above-identified patent and that said Letters Patent is hereby corrected as shown below:

Column 8,
Lines 6 and 7, “ration” should read -- ratio --
Lines 10 and 13, “another” should read -- other --
Line 21, “In another word,” should read -- In other words, --
Line 28, “is” should read -- are --
Line 31, “is” (both occurrences) should read -- are --
Line 56, “burning” should read -- burned --

Signed and Sealed this

Sixteenth Day of September, 2003

JAMES E. ROGAN
*Director of the United States Patent and Trademark Office*